United States Patent [19]

Fischer et al.

[11] 4,421,625

[45] Dec. 20, 1983

[54] LOWER PART OF A FUSED SALT ELECTROLYTIC CELL

[75] Inventors: Werner K. Fischer, Venthône; Ernst Bosshard, Fällanden, both of Switzerland

[73] Assignee: Swiss Aluminum Ltd., Chippis, Switzerland

[21] Appl. No.: 378,238

[22] Filed: May 14, 1982

[30] Foreign Application Priority Data

May 20, 1981 [CH] Switzerland ..... 3287/81

[51] Int. Cl.[3] ..... C25C 3/00

[52] U.S. Cl. ..... 204/243 R; 204/286

[58] Field of Search ..... 204/67, 243 R, 279, 204/243 M, 247

[56] References Cited

U.S. PATENT DOCUMENTS

| | | | |
|---|---|---|---|
| 2,861,036 | 11/1958 | Simon-Suisse | 204/243 R |
| 3,702,815 | 11/1972 | Nikiforov et al. | 204/243 R |
| 4,124,476 | 11/1978 | Rapolthy | 204/243 R |
| 4,322,282 | 3/1982 | Jemec | 204/243 R |

FOREIGN PATENT DOCUMENTS

| | | | |
|---|---|---|---|
| 205244 | 9/1959 | Austria | 204/67 |
| 483456 | 12/1975 | U.S.S.R. | 204/243 R |
| 737503 | 6/1980 | U.S.S.R. | 204/243 R |
| 742488 | 6/1980 | U.S.S.R. | 204/243 R |
| 768857 | 7/1980 | U.S.S.R. | 204/243 R |
| 775183 | 10/1980 | U.S.S.R. | 204/243 R |

*Primary Examiner*—Howard S. Williams
*Assistant Examiner*—T. Williams
*Attorney, Agent, or Firm*—Bachman and LaPointe

[57] ABSTRACT

A lower part of a fused salt reduction cell used in the production of aluminum, comprises an electrolyte tank supported by metal beams. The tank is made up of an outer steel tank, a thermally insulating layer and an inner electrically conductive carbon lining which can withstand molten metal. A frame of steel sections arranged in a grid-like pattern in the longitudinal direction is made up of single, massive side sections and, spaced apart in keeping with strength requirements and cell design, so called cradles which enclose the side sections. The cradles are made up of pairs of solid side posts secured to lower supporting sections and upper bracing sections. The electrolyte tank is situated in the frame and fixed in place against the side sections via counteracting elements which can be deformed plastically or elastically.

21 Claims, 3 Drawing Figures

LOWER PART OF A FUSED SALT ELECTROLYTIC CELL

BACKGROUND OF THE INVENTION

The present invention relates to a support for the lower part of a fused salt electrolytic cell used in the production of aluminum. The cell comprises an electrolyte tank with an outer steel tank, a thermally insulating layer and an electrically conductive inner carbon lining which is able to withstand the molten contents of the cell.

Aluminum is produced from aluminum oxide by the fused salt electrolytic process in which the aluminum oxide is dissolved in a fluoride melt comprised of, for the greater part, cryolite. The cathodically deposited aluminum collects under the fluoride melt on the carbon floor of the cell. The surface of the liquid aluminum provided forms the cathode. Dipping into the melt from above are anodes which, in conventional processes, are made of amorphous carbon. As a result of the electrolytic decomposition of the aluminum oxide, oxygen forms at the carbon anodes and combines with the carbon therein to form $CO_2$ and CO. The electrolytic process takes place in the temperature range around 940°-970° C.

During the course of production, the carbon lining experiences a significant increase in volume due to the penetration by components from the electrolyte. The term components as used here is to be understood to mean for example, sodium or salts making up the fluoride melt and chemical compounds which arise from unidentified reactions in the fluoride melt.

As a result of the increase in volume, the carbon lining exerts pressure on the thermal insulation and thus indirectly on the steel tank which suffers irreversible plastic deformation capable of producing cracks in the tank. The carbon lining itself becomes deformed, mostly with the floor doming upwards, resulting in cracks therein. The liquid aluminum may then leak through these cracks and attack the iron cathode bars which conduct away the direct electric current. The destruction of the cell lining may advance to such a degree that the molten aluminum runs out of the cell. In such a case the cell usually has to be put out of service. The cracking of the cell leads to expensive repairs as well as production loss due to the downtime of the cell.

Many attempts have been made in the past to prevent such deformation and cracks by reinforcing the steel tank. Such attempts have not been able to prevent the deformation and cracking and have only been able to reduce the frequency of occurrence. Furthermore, attempts to reinforce the cell represent a significant economic handicap as the cell becomes much more expensive. In addition the total weight of the cell tank is greatly increased.

Other attempts at overcoming the problem have aimed at saturating the carbon lining with electrolyte components in an attempt to overcome the increase in volume so produced thereby. It has been found, however, that the increase in volume cannot be avoided and must be accepted as a given characteristic.

In the German patent application published for opposition DE-AS 1 005 739 an attempt is made to increase both the strength and the service life of the steel tank by constructing the tank out of a number of different parts which can be displaced relative to each other. These individual parts are mounted by means of elastic elements on the stationary frame above the cell. However, since the means of reinforcement is replaced by a complicated tank construction the overall investment costs remain high.

In U.S. Pat. No. 4,124,476 it is suggested that a projection be provided in the steel tank. This comprises a first, easily deformable material and a second material which deforms only under higher forces, filling completely a space to accommodate the floor of the carbon lining, which expands in the horizontal direction during operation of the cell. The second material exhibits such properties that the forces can be transformed to the shaped steel shell without permanent deformation and/or forming cracks. The counteractive forces operating on the floor of the carbon lining reduce the degree of doming by the floor and the formation of through cracks there.

A suggestion to fit the electrolyte tank with reinforcements but to permit the elastic expansion of the tank is made in U.S. Pat. No. 4,322,282. The reinforcements on the sidewalls of the cell are elastic and are mounted with facilities which permit them to be moved. These reinforcing elements are preferably hollow so that a temperature gradient of 100°-200° C. can form in the section.

Finally, in German patent application No. 21 22 246 an electrolytic cell is described wherein the steel shell is in the form of a box and is provided with horizontal beams on the short sides and floor of the cell and vertical beams on the long sides. Bolts, with round nuts, provide a hinged connection between the floor and the vertical beams, the lower ends of which are supported in pairs by spacers.

Although the state of the art suggestions provide some alleviation of the difficulties, electrolytic cells with extremely high current densities still produce very great problems. Modern aluminum fused salt electrolytic cells with a power rating of over 200 kA must be constructed longer and not broader because this is the way that magnetic problems can be more easily kept under control. With such long, narrow cells there is a greater tendency for thermal expansion of the carbon lining to cause torsional distortion along the longitudinal axis which can even lead to buckling perpendicular to the long axis of the cell. This so called "shoe-box" effect must therefore be prevented without anchoring the cell in a manner that results in cracks starting to form.

It is therefore a principal object of the present invention to develop a mechanism for the lower part of a fused salt electrolytic cell which in all sizes, in particular cells with power ratings over 200 kA, are capable of preventing uncontrollable deformation of the cell so as to prevent damage due to crack formation. The mechanism is realizable at low investment cost and is flexible in its application.

SUMMARY OF THE INVENTION

This foregoing object is achieved by the way of the present invention wherein a framework of steel sections, arranged in a grid-like pattern in the longitudinal direction, and made up of single massive side sections running the full length of the cell and, spaced apart in keeping with strength requirements and cell design, so called cradles which enclose the side sections and such that these cradles are made up of pairs of solid side posts secured to lower supporting sections and upper bracing sections, and an electrolyte tank situated in the said framework and fixed in place against the side sections via connecting elements which can be deformed plastically or elastically.

The pressure at the sides of the cell, which are caused by the carbon lining and increase with the age of the cell, have to be resisted by the horizontal side sections and the vertical posts of the framework. Both of these types of sections must, therefore, be solid in cross section, for example, in the form of a wide-flanged double-T beam or U-beam. Steel sections with a wall thickness of at least 1 cm and flange and strut length of more than 10 cm can withstand the forces if the side sections are secured every 5 m of the inner flange by side posts.

The transverse supporting sections on the other hand have only the weight of the cell to support as no forces of expansion act on these sections. Also, these supporting sections can be supported at a plurality of places, in the limiting case over the whole length. In the last case, in particular upright narrow I-beams which apart from their load bearing function only have to bear the tensile forces acting through the side posts, are adequate for that purpose.

The upper, bracing sections, only have to withstand the tensile forces transmitted via the side posts. These sections are in the form of narrow upright I-beams in order that the work and facilities at the cell are not unduly hindered by them. The bracing sections run just a little above the cell, preferably 1–70 cm.

The individual sections making up the frame are joined together in a conventional manner either releasably, that is with screws, bolts or joints (sections fitted together) or permanently, that is by welding.

The side posts can also be mounted, hinged on the supporting sections.

For magnetic and economic reasons large cells, that is cells over 150 kA fused salt electroytic cells used in producing aluminum are installed transversely in the pot room. In this case the direct electric current is fed not only into the narrow side but also the long side of the anode beam. The frame according to the present invention is constructed low and in such a way that the feeding of the current into the side of the anode beam can be made above the steel sections. As a result, work at the electroytic cell is hindered only a little or not at all by the frame.

The cradles made up of the lower, supporting sections, side posts and upper bracing sections are arranged, depending on strength requirements and cell design, in such a manner that the side posts can withstand the pressure from the pot without suffering any appreciable deformation. On the other hand there must not be so many cradles that the investment costs increase too much or that work at the cell, that is, charging anodes, is severely restricted. The cradles are therefore usefully arranged at a spacing of 1 to 5 m, preferably between 3 and 4 m. As the whole fused salt reduction cell is constructed on a uniform, geometric basis, the cradles are also preferably arranged a uniform distance apart.

The number of horizontally arranged side posts is usually at least two on each side of the cell, with at least one side post being positioned in the region of the carbon floor as it is there that the largest forces are exerted.

The frame according to the present invention is, in the case of cells with high to very high currents, able to prevent not only the sideways expansion but also twisting in the longitudinal direction of the cell or buckling perpendicular to the longitudinal axis. This is particularly important because, especially in large, that is, long cells, the bending of the sidewalls is a function of the cube of the cell length 1 thus the bending of the sidewalls increases in proportion to the length of the third power.

The cell tank of the lower part of a cell according to the present invention need therefore no longer be designed as a complicated box with reinforcing elements; it is rather, limited by a simple outer steel tank. Plastically or elastically formable elements are provided between the tank and the side posts of the frame. These elements can be of the pre-stressed kind i.e. the cold cell e.g. already when stamping-in the carbon mass, can be subjected to a counter pressure by the deformable elements. This creates an outer space for accommodating stress and such that the counter pressure can be set at will by the appropriate choice of deformable elements. Cup springs which can be adjusted by a torque wrench have been found to be very suitable for this purpose. Usefully, the supporting sections are also fitted out with such deformable elements.

Analogous to U.S. Pat. No. 4,,124,476 it has also been found advantageous to create two-stage stress accommodating spaces. These are however not situated in a recess in the steel tank but between the steel tank and the horizontal side sections. One can therefore build into this region outside the tank a first, easily deformable material and a second material which can be deformed only by larger forces. In this connection attention is drawn in particular to FIGS. 4 to 7 and their description in U.S. Pat. No. 4,124,476. The second, more difficult to deform material is positioned at the level of the carbon floor. In order that the counter pressure can be resisted a solid side section runs at the same level in the cell frame.

Finally, a further essential feature is that the frame according to the present invention with solid, continuous side sections permits a reduction pot to be constructed of unit elements. For example in the case of a fused salt reduction cell for producing aluminum a transverse cell can be constructed out of pot units which permit an operating current of 60 kA. The modular construction method is based on pot units which are preferably pushed together and, if they become defective prematurely, can be exchanged. This can be of very great advantage from the economic standpoint.

BRIEF DESCRIPTION OF THE DRAWINGS

The present invention will be explained in greater detail with reference to the schematic drawings wherein.

DETAILED DESCRIPTION

Figure 1:
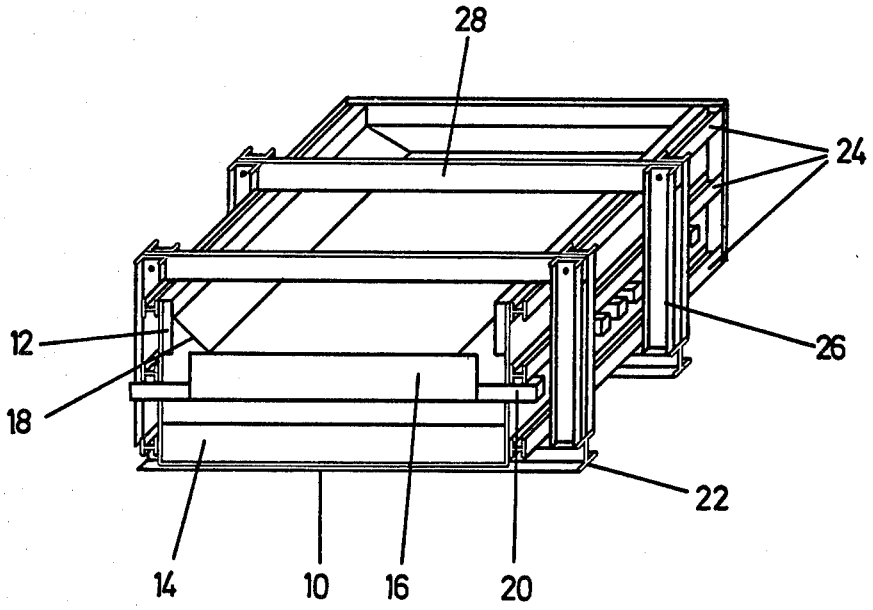
FIG. 1 is a sectional, perspective view of a part of an aluminum reduction cell

The part of the lower section of an aluminum electrolytic reduction cell shown in FIG. 1 comprises essentially a frame in which a tank resides. This electrolyte tank is delimited on the outside by a steel tank 10 which is reinforced at the upper edge by building out a rectangular carbon block 12. An insulating layer 14 prevents excessive loss of heat during the operation of the cell. The inner carbon lining comprises the tank floor 16 and the sidewall 18. These shaped carbon blocks form the cathode in the empty reduction cell; the direct electric current is conducted away through iron cathode bars 20.

During the electrolytic process the carbon lining 16,18 is filled with liquid aluminum and electrolyte lying on top of the aluminum.

The floor of the steel tank is supported by beams 22 which are in the form of upright I-beams or narrow double-T sections. The sidewalls of the steel tank are supported on each side by three broad-flanged double-T sections which run horizontally the whole length of the cell. The middle side section 24 lies at the height of the carbon floor 16. All side sections 24 are in turn secured to facing U-section posts which form the side posts 26. Each pair of U-section side posts 26 in the present case is welded to one end of a supporting section 22 and is anchored by means of bolts to bracing sections 28.

A supporting section 22, two side posts 26 and a bracing section 28 form a so called cradle. Thes cradles are in the present example spaced apart at a distance four times the distance between the cathode bars 20. The bracing section 28 must not be at the cathode potential. Either the whole cradle or the bracing section 28 must be insulated from the side posts 26.

Figure 2:
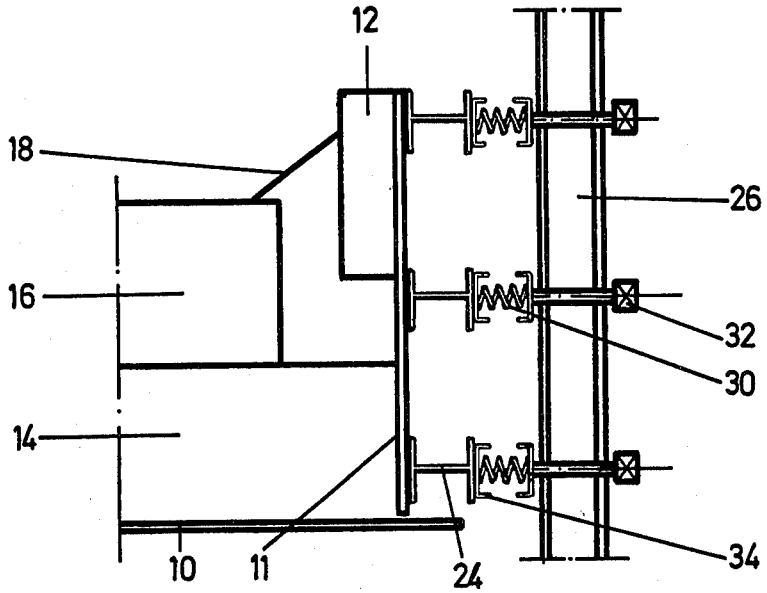
FIGS. 2 and 3 are vertical sections of part of an aluminum reduction cell showing the elastically or plastically deformable elements omitted in FIG. 1 for reasons of clarity.

The enlarged side region of a reduction cell, shown in FIG. 2, shows a vertical space between the side sections 24 which are welded to the sidewall 11 of the steel tank 10 and the side posts 26.

The compression springs 30 between pairs of disc-like plates 34 can be preset individually by means of bolts 32. When the cell is cold, all springs can be set with the same compressive force. As the greatest pressure is produced by the carbon floor, however, the springs at that level are preferably adjusted to provide a higher compressive force there.

Figure 3:
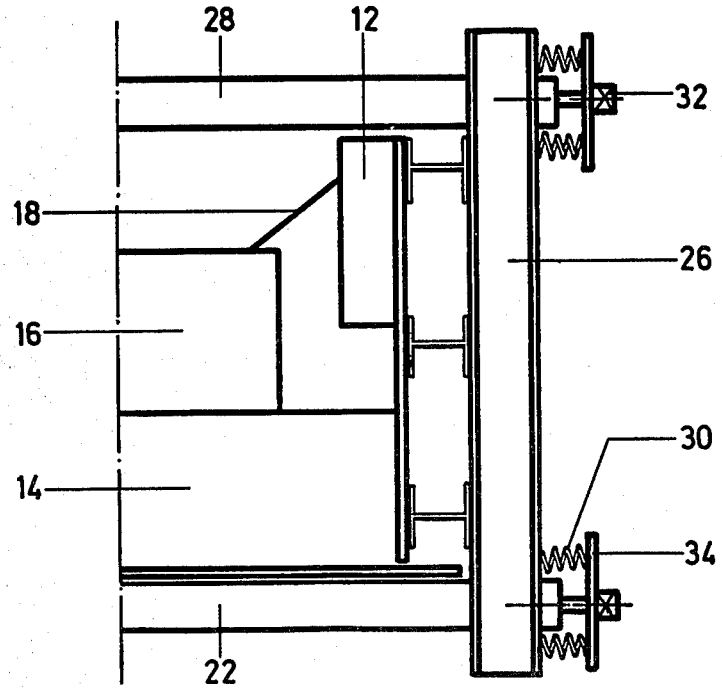

In the arrangement shown in FIG. 3 the side sections 24 which are welded to the sidewall 11 of the steel tank 10 lie directly against the side posts 26. The supporting sections 22 and bracing sections 28 are fixed and fitted out at the ends to accept bolts 32. Individual presetting of the side posts to provide the necessary compression on the sidewall 11 of the cell 10 is made possible here via bolts 32 which press a bracing plate 34 which in turn acts on at least one compression spring 30.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. In an electrolytic cell used in the production of aluminum comprising an outer steel tank, a thermal insulating layer and an electrically conductive inner carbon lining, the improvement which comprises a metal framework for supporting the lower portion of said cell comprising:

at least one side section on the longitudinal sides of said cell and running the full length thereof;

a plurality of cradles enclosing said side section, each of said cradles having a lower supporting section running under said cell, an upper bracing section running over said cell and a pair of side posts on either longitudinal side of said cell, each of said posts being secured to one end of said lower supporting section and said upper bracing section; and means associated with said cradles and said side section for counteracting the forces produced in said cell.

2. A metal framework according to claim 1 wherein the plurality of cradles are arranged on either longitudinal side of the cell at a spacing of from about 1 to 5 m.

3. A metal framework according to claim 1 wherein the plurality of cradles are arranged on either longitudinal side of the cell at a spacing of from about 3 to 4 m.

4. A metal framework according to claim 1 wherein the plurality of cradles are arranged on either longitudinal side of the cell at equal spacings.

5. A metal framework according to claim 1 wherein said upper bracing section running over the cell is at a distance of from about 1 to 70 cm above said cell.

6. A metal framework according to claim 1 wherein said means for counteracting the forces produced in said cell is adjustable.

7. A metal framework according to claim 1 wherein said means for counteracting the forces produced in said cell comprises springs.

8. In an electrolytic cell used in the production of aluminum comprising an outer steel tank, a thermal insulating layer and an electrically conductive inner carbon lining, the improvement which comprises a metal framework for supporting the lower portion of said cell comprising:

at least two side sections arranged substantially parallel to each other on the longitudinal sides of said cell and running the full length thereof wherein at least one of the side sections on the longitudinal sides of said cell is positioned at the height of the floor of the carbon lining;

a plurality of cradles enclosing said side section, each of said cradles having a lower supporting section running under said cell, an upper bracing section running over said cell and a pair of side posts on either longitudinal side of said cell, each of said posts being secured to one end of said lower supporting section and said upper bracing section; and means associated with said cradles and said at least two side sections for counteracting the forces produced in said cell.

9. A metal framework according to claim 8 wherein the plurality of cradles are arranged on either longitudinal side of the cell at a spacing of from about 1 to 5 m.

10. A metal framework according to claim 8 wherein the plurality of cradles are arranged on either longitudinal side of the cell at a spacing of from about 3 to 4 m.

11. A metal framework according to claim 8 wherein said upper bracing section running over the cell is at a distance of from about 1 to 70 cm above said cell.

12. In an electrolytic cell used in the production of aluminum comprising an outer steel tank, a thermal insulating layer and an electrically conductive inner carbon lining, the improvement which comprises a metal framework for supporting the lower portion of said cell comprising:

at least two side sections arranged substantially parallel to each other on the longitudinal sides of said cell and running the full length thereof wherein at least one of the side sections on the longitudinal sides of said cell is positioned at the height of the floor of the carbon lining;

a plurality of cradles enclosing said side section, each of said cradles having a lower supporting section running under said cell, an upper bracing section running over said cell and a pair of side posts on either longitudinal side of said cell, each of said posts being secured to one end of said lower supporting section and said upper bracing section; and means associated with said cradles and said at least two side sections for counteracting the forces produced in said cell wherein said means for counteracting the forces produced in said cell comprises a plurality of springs mounted between said at least two side sections and said pair of side posts and further includes means associated with said plurality of springs for adjusting the force of said springs on said at least two side sections.

13. A metal framework according to claim 12 wherein the plurality of cradles are arranged on either longitudinal side of the cell at a spacing of from about 1 to 5 m.

14. A metal framework according to claim 12 wherein the plurality of cradles are arranged on either longitudinal side of the cell at a spacing of from about 3 to 4 m.

15. A metal framework according to claim 12 wherein said upper bracing section running over the cell is at a distance of from about 1 to 70 cm above said cell.

16. In an electrolytic cell used in the production of aluminum comprising an outer steel tank, a thermal insulating layer and an electrically conductive inner carbon lining, the improvement which comprises a metal framework for supporting the lower portion of said cell comprising:

at least two side sections arranged substantially parallel to each other on the longitudinal sides of said cell and running the full length thereof wherein at least one of the side sections on the longitudinal sides of said cell is positioned at the height of the floor of the carbon lining;

a plurality of cradles enclosing said side section, each of said cradles having a lower supporting section running under said cell, an upper bracing section running over said cell and a pair of side posts on either longitudinal side of said cell, each of said posts being secured to one end of said lower supporting section and said upper bracing section; and means associated with said cradles and said at least two side sections for counteracting the forces produced in said cell wherein said pair of side posts abut said at least two side sections and wherein said means for counteracting the forces produced in said cell comprises a plurality of springs mounted on said pair of side posts and further includes means associated with said plurality of springs, said lower supporting section and said upper bracing section for adjusting the force of said springs on said pair of side posts.

17. A metal framework according to claim 16 wherein the plurality of cradles are arranged on either longitudinal side of the cell at a spacing of from about 1 to 5 m.

18. A metal framework according to claim 16 wherein the plurality of cradles are arranged on either longitudinal side of the cell at a spacing of from about 3 to 4 m.

19. A metal framework according to claim 16 wherein said upper bracing section running over the cell is at a distance of from about 1 to 70 cm above said cell.

20. A metal framework according to claim 16 wherein said means associated with said plurality of springs, said lower support section and said upper bracing section comprises a plurality of members one of each being adjustably mounted in said lower support section and said upper bracing section respectively for biasing said plurality of springs against said pair of side posts.

21. In an electrolytic cell used in the production of aluminum comprising an outer steel tank, a thermal insulating layer and an electrically conductive inner carbon lining, the improvement which comprises a metal framework for supporting the lower portion of said cell comprising:

at least one side section on the longitudinal sides of said cell and running the full length thereof;

a plurality of cradles enclosing said side section, each of said cradles having a lower supporting section running under said cell, an upper bracing section running over said cell and a pair of side posts on either longitudinal side of said cell, each of said posts being secured to one end of said lower supporting section and said upper bracing section; and means associated with said cradles and said side section for counteracting the forces produced in said cell wherein said cell is of modular construction and is made up of an assembly of individually exchangeable elements.

* * * * *